US008087940B1

(12) United States Patent
Lee et al.

(10) Patent No.: US 8,087,940 B1
(45) Date of Patent: Jan. 3, 2012

(54) COAXIAL ELECTRIC CONNECTOR

(75) Inventors: Yeh-Shing Lee, Yangmei (TW); Chun-Hao Hung, Yangmei (TW)

(73) Assignee: ABC Taiwan Electronics Corp., Taoyuan County (TW)

( * ) Notice: Subject to any disclaimer, the term of this patent is extended or adjusted under 35 U.S.C. 154(b) by 0 days.

(21) Appl. No.: 12/938,379

(22) Filed: Nov. 3, 2010

(51) Int. Cl.
*H01R 12/00* (2006.01)

(52) U.S. Cl. ..... 439/63

(58) Field of Classification Search ..... 439/63, 439/578–585, 394, 675, 854, 855, 859
See application file for complete search history.

(56) References Cited

U.S. PATENT DOCUMENTS 6,648,653 B2 * 11/2003 Huang et al. ..... 439/63
* cited by examiner

*Primary Examiner* — Tulsidas C Patel
*Assistant Examiner* — Phuong Nguyen
(74) *Attorney, Agent, or Firm* — Leong C. Lei

(57) ABSTRACT

A coaxial electric connector includes primarily a dielectric shell and a housing unit which is in an arc shape. The dielectric shell is formed by extrusion formation based on the housing unit and defines an annular space, with a predetermined wall being formed with two fixing sections to define the arc according to the housing unit. Besides, a bottom of the dielectric shell is a dielectric base and an interior of the dielectric shell contains additionally a conductor, a position of which is fixed by the dielectric base. A conductor pin on the conductor, whereas, is extended outward from the dielectric base. Through wrapping of the dielectric shell, the housing unit increases roundness of the entire housing and decreases scratching on a surface of metal part, which occurs when manufacturing the products, thereby improving a yield rate and a service life of the products.

2 Claims, 5 Drawing Sheets

COAXIAL ELECTRIC CONNECTOR

BACKGROUND OF THE INVENTION a) Field of the Invention

The present invention relates to a coaxial electric connector and more particularly to a coaxial electric connector which is primarily used on a portable electronic product.

b) Description of the Prior Art

As evolvement of technologies, all kinds of portable electronic products, such as a cell phone, a PDA (Personal Digital Assistant) and a laptop computer, are gradually moving toward compactness to better comply with convenience of portability; whereas, miniaturization of related electronic parts in the products is also becoming an unavoidable trend.

Taking a coaxial electric connector used in the laptop computer as an example, the coaxial electric connector is composed of a socket and a plug. A bottom of the socket is installed on a motherboard of the laptop computer and two ends of the plug are installed respectively on the socket and an antenna, with transmission and receiving of signals being achieved through a coaxial cable. As shown in FIG. 1 and FIG. 2, a metallic housing 10 of this coaxial electric connector 1 is formed by stamping that a flat-plate-shaped raw material belt is wrapped into the annular metallic housing 10. However, it is not easier for this method to maintain roundness of the housing 10 in manufacturing, which not only affects transmission of signals, but also easily causes scratch on a surface in post-manufacturing due to the imperfect roundness, thereby affecting an appearance, a yield rate and a service life of the product. In addition, the housing is only extended outward with a single pin, which is less sufficient in stability.

Accordingly, how to solve the aforementioned issues and shortcomings of the prior art is a direction of research and development for improvement by the present inventor and related vendors.

SUMMARY OF THE INVENTION

The primary object of the present invention is to provide a coaxial electric connector which is primarily constituted by a dielectric shell and a housing unit, wherein the housing unit is in an arc shape and the dielectric shell is formed by extrusion formation based on the housing unit. The dielectric shell surrounds an annular space and two fixing sections are formed on a predetermined wall thereof, allowing the fixing sections to define the arc according to the housing unit. Besides, a bottom of the dielectric shell is provided with a dielectric base and an interior of the dielectric shell is additionally provided with a conductor. A position of the conductor is fixed by the dielectric base and a conductor pin on the conductor is extended outward from the dielectric base. Through wrapping of the dielectric shell, the roundness of the entire housing is improved and scratching which occurs on a surface of a metal part when manufacturing the product is reduced, thereby improving the yield rate and the service life of the product.

Differing from a pin type of the conventional coaxial electric connector, the present invention is only provided with three conductor pins which are extended outward and are all on a same plane. This pin type will facilitate processing of mold tools during the post-manufacturing. In a mean time, contact areas of the pins with the raw material belt are decreased, which will not easily damage the finished products when executing a cutoff process.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
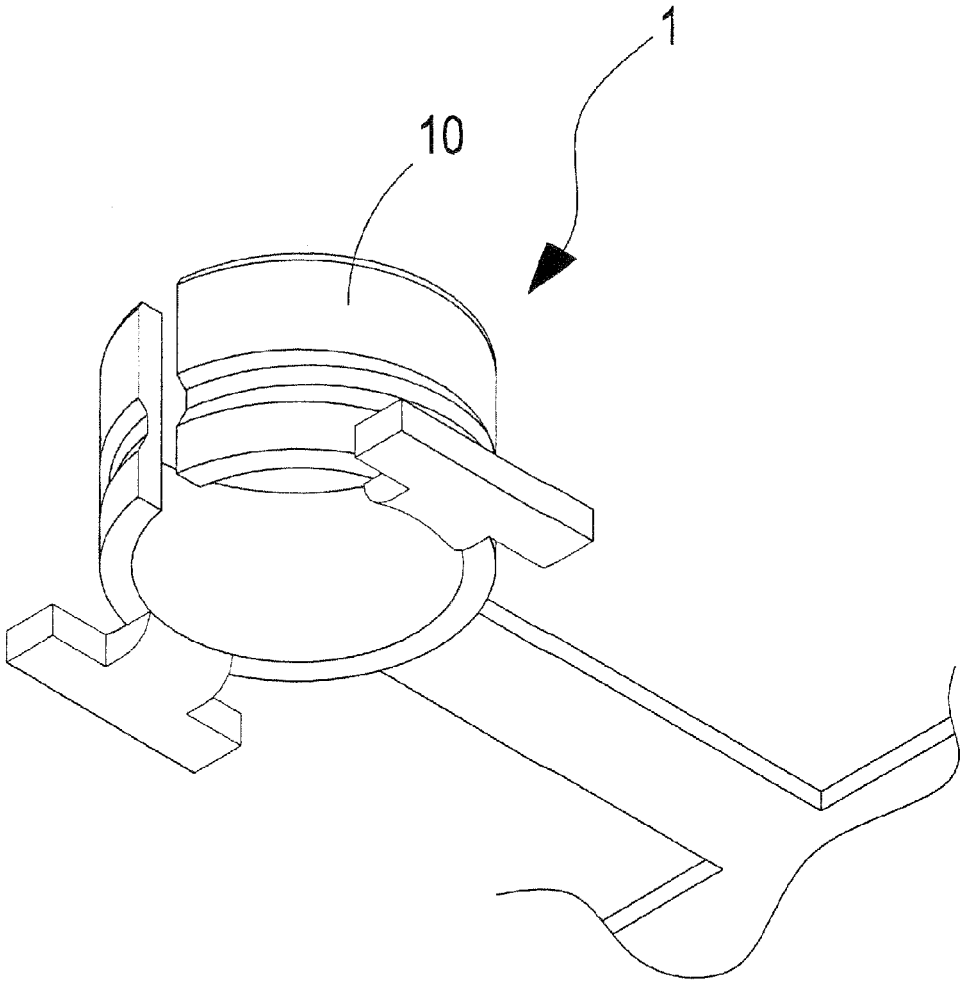
FIG.1 PRIOR ART
FIG. 1 shows a schematic view of a housing of a conventional coaxial electric connector.
Figure 2:
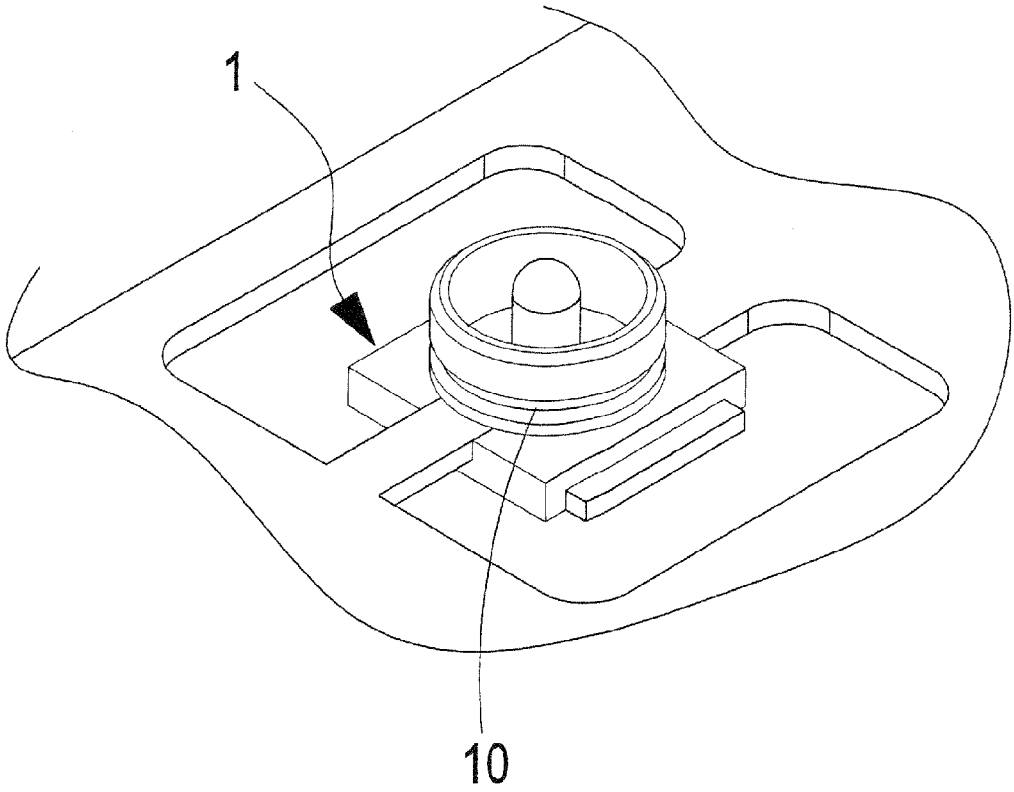
FIG.2 PRIOR ART
FIG. 2 shows a schematic view of a socket of the conventional coaxial electric connector.
Figure 3:
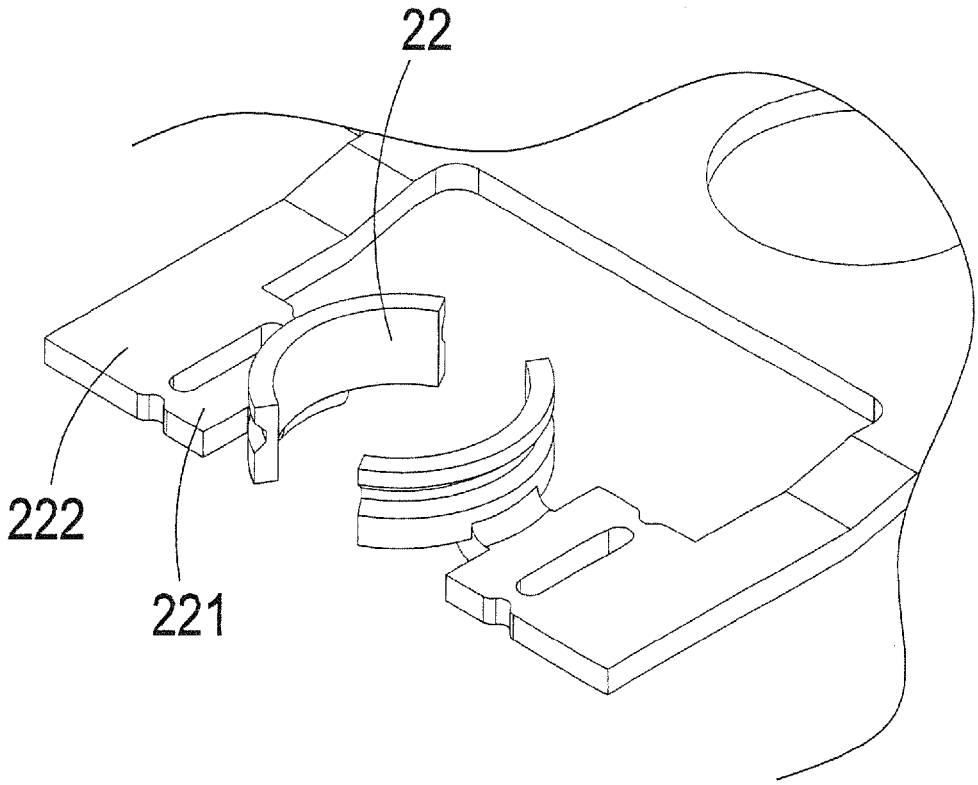
FIG. 3 shows a three-dimensional schematic view of a housing of a coaxial electric connector of the present invention.
Figure 4:
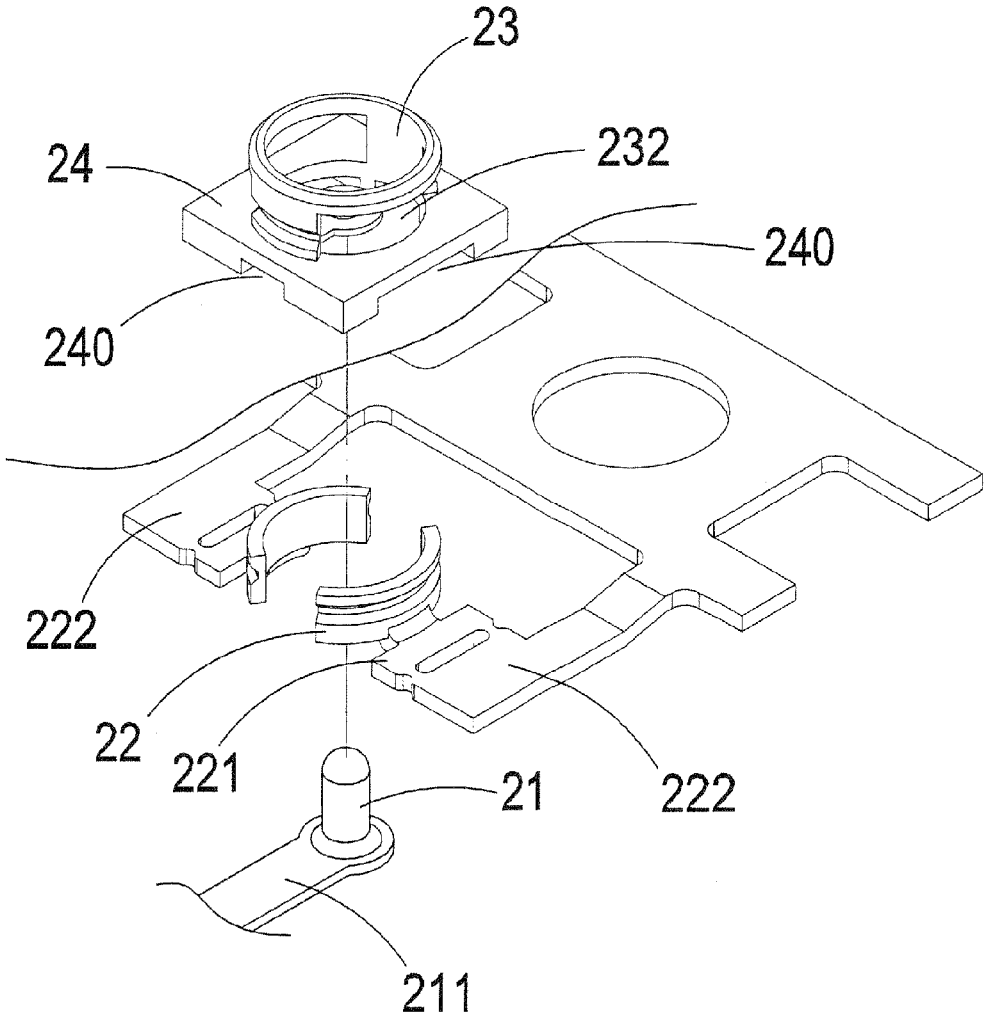
FIG. 4 shows a three-dimensional exploded view of a socket of the coaxial electric connector of the present invention.
Figure 5:
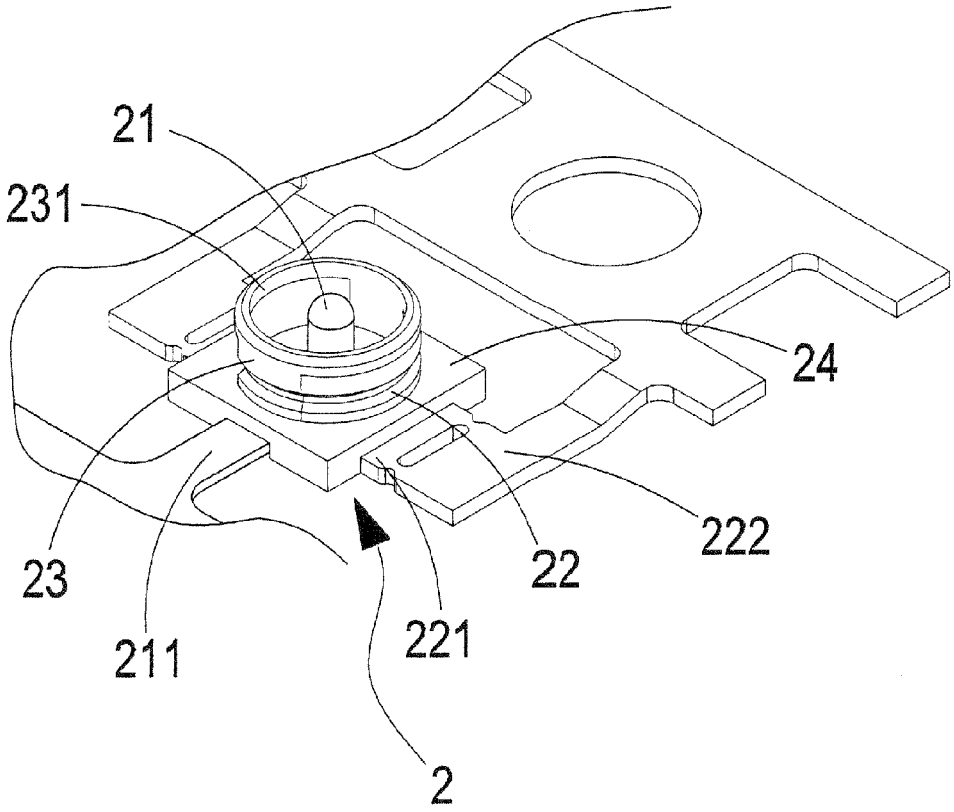
FIG. 5 shows a three-dimensional schematic view of the socket of the coaxial electric connector of the present invention.

Referring to FIGS. 3 to 5, it shows a three-dimensional schematic view of a housing, a three-dimensional exploded view of a socket and a three-dimensional schematic of the socket, of a coaxial electric connector of the present invention. As shown in the drawings, the present invention is a coaxial electric connector 2 which comprises primarily a dielectric shell 23 and a housing unit 22, wherein the housing unit 22 is in an arc shape and the dielectric shell 23 is formed by extrusion formation based on the housing unit 22. The dielectric shell 23 surrounds an annular space 231 and two fixing sections 232 are formed on a predetermined wall thereof, allowing the fixing sections 232 to define the arc according to the housing unit 22. An end of the housing unit 22 is extended with a welding pin 221 of a connection part 222 which is used for connecting each housing unit 22. Besides, a bottom of the dielectric shell 23 is provided with a dielectric base 24 on which are formed with plural positioning grooves 240. Using the positioning grooves 240, a conductor pin 211 on a conductor 21 can be fixed; whereas, the welding pins 221 on the housing units 22 can be also fixed through the positioning grooves 240. Through the aforementioned structures, as the dielectric shell 23 is a right circular body, each arc-shaped housing unit 22 is able to improve the roundness of the entire housing through the wrapping of the dielectric shell 23; in addition, scratching which occurs on a surface of a metal part when manufacturing the products is decreased, thereby improving a yield rate and a service life of the products.

As shown in the aforementioned drawings, the present invention only includes three pins which are extended out of the dielectric base 24 and the welding pins 221 and the conductor pin 221 are all on a same plane, which more facilitates the manufacturing of mold tools.

It is of course to be understood that the embodiments described herein is merely illustrative of the principles of the invention and that a wide variety of modifications thereto may be effected by persons skilled in the art without departing from the spirit and scope of the invention as set forth in the following claims.

We claim:

1. A coaxial electric connector comprising:

a housing unit having two opposite arc-shaped portions, each of said arc-shaped portions having an outer side extended with a welding pin which is integral with a connection part;

a right circular dielectric shell having a bottom provided with a dielectric base on which are formed with a plurality of positioning grooves, said circular dielectric shell having an annular space adapted to receive said housing unit and said circular dielectric shell having a predetermined wall formed with two fixing sections under the annular space; the two fixing sections assembled with two opposite arc-shaped portions of said housing unit thereby providing roundness of said housing unit through wrapping of said right circular dielectric shell, said circular dielectric shell being engaged with said housing unit with said positioning grooves engaged with said welding pins; and a conductor provided with a conductor pin, said conductor being engaged with said positioning groove of said circular dielectric shell with said conductor pin located at a central position of said annular space.

2. The coaxial electric connector as claimed in claim 1, wherein said welding pins and said conductor pin are all on a same plane.

* * * * *